US008177345B2

(12) United States Patent
Sakai et al.

(10) Patent No.: US 8,177,345 B2
(45) **Date of Patent: *May 15, 2012**

(54) LIQUID EJECTING HEAD, LIQUID EJECTING APPARATUS, AND METHOD FOR MANUFACTURING LIQUID EJECTING HEAD

(75) Inventors: Toshifumi Sakai, Shiojiri (JP); Toru Nagate, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 575 days.

This patent is subject to a terminal disclaimer.

(21) Appl. No.: 12/357,169

(22) Filed: Jan. 21, 2009

(65) Prior Publication Data

US 2009/0185006 A1 Jul. 23, 2009

(30) Foreign Application Priority Data

Jan. 22, 2008 (JP) ..... 2008-011215
Sep. 17, 2008 (JP) ..... 2008-237528

(51) Int. Cl.
*B41J 2/17* (2006.01)
*B41J 2/045* (2006.01)

(52) U.S. Cl. ..... 347/94; 347/70

(58) Field of Classification Search ..... 347/68–72, 347/94

See application file for complete search history.

(56) References Cited

U.S. PATENT DOCUMENTS 6,193,360 B1 * 2/2001 Nishiwaki et al. ..... 347/70
7,645,032 B2 * 1/2010 Watanabe ..... 347/71
2002/0109744 A1 8/2002 Shindo
2005/0040581 A1 2/2005 Ito
2008/0079777 A1 4/2008 Watanabe
2008/0309735 A1 12/2008 Watanabe

FOREIGN PATENT DOCUMENTS

EP 1 498 268 A1 1/2005
EP 1 504 902 A1 2/2005
JP 2001-105595 4/2001
JP 2005-041047 2/2005

OTHER PUBLICATIONS

U.S. Appl. No. 12/357,140, mailed Aug. 10, 2011, Office Action.

* cited by examiner

*Primary Examiner* — Geoffrey Mruk

(74) *Attorney, Agent, or Firm* — Workman Nydegger

(57) ABSTRACT

A liquid ejecting head including a plurality of nozzle orifices for liquid ejection, a reservoir plate made of rolled metal rolled in a first direction which includes a liquid reservoir communicating with the plurality of nozzle orifices, and a compliance plate made of rolled metal rolled in a second direction, laminated on the reservoir plate, and having a thin portion that is formed by forming a recess which extends in the lengthwise direction in the opposite surface of the reservoir plate from the surface facing the liquid reservoir, the thin portion serving as a wall of the liquid reservoir. The second direction is perpendicular to the longitudinal direction of the recess and the first direction is perpendicular to the second direction.

9 Claims, 4 Drawing Sheets

LIQUID EJECTING HEAD, LIQUID EJECTING APPARATUS, AND METHOD FOR MANUFACTURING LIQUID EJECTING HEAD

The entire disclosures of Japanese Patent Application Nos. 2008-011215, filed Jan. 22, 2008 and 2008-237528, filed Sep. 17, 2008 are expressly incorporated herein by reference.

BACKGROUND OF THE INVENTION

1. Technical Field

The present invention relates to a liquid ejecting head, a liquid ejecting apparatus, and a method for manufacturing a liquid ejecting head. More specifically, the present invention relates to a pressure chamber forming plate, compliance plate, and nozzle plate for a liquid ejecting head.

2. Related Art

One method currently used for forming a recording head comprises forming a ink jet recording head having a plurality of nozzle orifices capable of discharging ink using a laminating process in order to form a pressure chamber forming plate, a compliance plate, and a nozzle plate. The nozzle plate has a plurality of nozzle orifices arranged in a predetermined configuration. The pressure chamber forming plate forms a plurality of pressure chambers which respectively communicate with the plurality of nozzle orifices. The pressure chamber forming plate has a reservoir which communicates with each pressure chamber via an ink supply passage. The reservoir leads to an opening on the surface of the pressure chamber forming plate on the side of the compliance plate, which is covered by the compliance plate. Ink supplied to the reservoir, from an ink cartridge, for example, is supplied to each pressure chamber through an ink supply passage. Each pressure chamber is provided with a piezoelectric element. When a predetermined drive voltage is applied to one of the piezoelectric elements, the piezoelectric element is deformed (extended), and the pressure chamber is pressurized. As a result, the ink in the pressure chamber is pushed out through the corresponding nozzle orifice and discharged in the form of an ink droplet.

Ink supplied to the recording head, such as ink supplied from an ink cartridge, is temporarily stored in the reservoir before it is supplied to each pressure chamber. At this time, if a large amount of ink is supplied to the reservoir, an excessive pressure may be applied to the reservoir. As a result, ink may be oversupplied to each pressure chamber, and the unnecessary discharge of dots can occur. In order to alleviate this problem, the compliance plate has a recess formed on the side of the nozzle plate, in a portion corresponding to the location of the reservoir. Because of the recess, that portion of the compliance plate is thinner than the rest. Thus, when ink is supplied to the reservoir and the pressure in the reservoir is increased, the thin portion (called compliance portion) is pressed by the ink in the reservoir and bends toward the nozzle plate, thereby absorbing the increased pressure in the reservoir and preventing an erroneous discharge from occurring.

In one ink jet printer head currently known in the art described in Japanese Patent Application No. JP-A-2005-41047, a base plate where the pressure chambers are formed is made from a rolled metal plate where the rolling direction is parallel to the longitudinal direction of the pressure chambers. In another ink jet recording head described in Japanese Patent Application No. JP-A-2005-41047, the nozzle plate is formed from a rolled metal plate where the longitudinal direction of the planar profile is substantially perpendicular to the rolling direction.

Recently, attempts have been made to increase the number of nozzles and to reduce the size of the products. In order to successfully reduce the size of the products, the size of each plate of the recording head needs to be reduced. To reduce the size of each plate, it is necessary to reduce the area of the compliance portion. On the other hand, the amount of ink being supplied to the reservoir is increasing due to the above densification. Unfortunately, the rigidity of the thin portion is reduced when the thickness of the compliance plate reduced, meaning that the thin portion may be excessively bent in response to the pressure generated in the reservoir. As a result, a part of the bent thin portion can come into contact with the nozzle plate. Under such circumstances, the thin portion cannot serve as a pressure absorber Each plate of the above recording head is made by rolling metal. Such rolled plates tend to warp in the rolling direction. Such warping of the plates results in the warping of the whole recording head. The warping of the recording head causes, for example, variation in the distance between the nozzles and a recording medium onto which dots are discharged. Thus, warped recording heads are defective products. This is a problem not only for ink jet recording heads that discharge ink but also for various liquid ejecting heads.

BRIEF SUMMARY OF THE INVENTION

An advantage of some aspects of the invention is to provide a liquid ejecting head, a liquid ejecting apparatus, and a method for manufacturing a liquid ejecting head capable of preventing excessive bending of the thin portion due to the increase in pressure generated in the reservoir, promoting downsizing (reduction in thickness) of products, and preventing warping from occurring.

A first aspect of the invention is a liquid ejecting head comprising a plurality of nozzle orifices capable of ejecting a liquid, a reservoir plate made of a rolled metal rolled in a first direction and forming a liquid reservoir which communicates with the plurality of nozzle orifices, and a compliance plate made of rolled metal rolled in a second direction which is laminated on the reservoir plate and having a thin portion that is formed by forming a recess which extends in a lengthwise direction in the surface of the compliance plate which is opposite to the surface facing the liquid reservoir, the thin portion forming a surface of the liquid reservoir extends. In the first aspect of the invention the second direction is perpendicular to the longitudinal direction of the recess and the first direction is perpendicular to the second direction.

According to the aspect of the invention, the compliance plate is rolled in a direction parallel to the width direction of the recess, which is perpendicular to the longitudinal direction. So, on the surface of the thin portion, minute lines formed during metal rolling run along the width direction. As a result, the thin portion is harder to bend, and a part of the thin portion is prevented from coming into contact with another member. In addition, since the thin portion is prevented from coming into contact with another member, the compliance plate can be further reduced in thickness. In addition, since the rolling direction of the compliance plate is perpendicular to the rolling direction of the reservoir plate, the warping of each plate is prevented, and the whole liquid ejecting head is thereby unlikely to warp.

A second aspect of the invention is a liquid ejecting apparatus capable of ejecting liquid from a plurality of nozzle orifices. The apparatus includes a liquid ejecting head section comprising a reservoir plate made of rolled metal rolled in a first direction, the reservoir plate forming a liquid reservoir which is capable of communicating with the plurality of nozzle orifices, and a compliance plate made of rolled metal rolled in a second direction which is disposed on the reservoir plate and having a thin portion that is formed by forming a recess which extends in a lengthwise direction in the surface of the compliance plate which is opposite to the surface facing the liquid reservoir, the thin portion forming a surface of the liquid reservoir. As described above, the second direction is perpendicular to the longitudinal direction of the recess and the first direction is perpendicular to the second direction.

A third aspect of the invention is a method for manufacturing a liquid ejecting head having a plurality of nozzle orifices capable of ejecting a liquid. The method comprises laminating a reservoir plate made of rolled metal rolled in a first direction which forms a liquid reservoir which is capable of communicating with the plurality of nozzle orifices and a compliance plate made of rolled metal rolled in a second direction which has a thin portion that is formed by forming a recess which extends in a lengthwise direction in a surface of the compliance plate opposite to the liquid reservoir, the thin portion serving as a wall of the liquid reservoir, wherein the second direction is perpendicular to the longitudinal direction of the recess and the first direction is perpendicular to the second direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
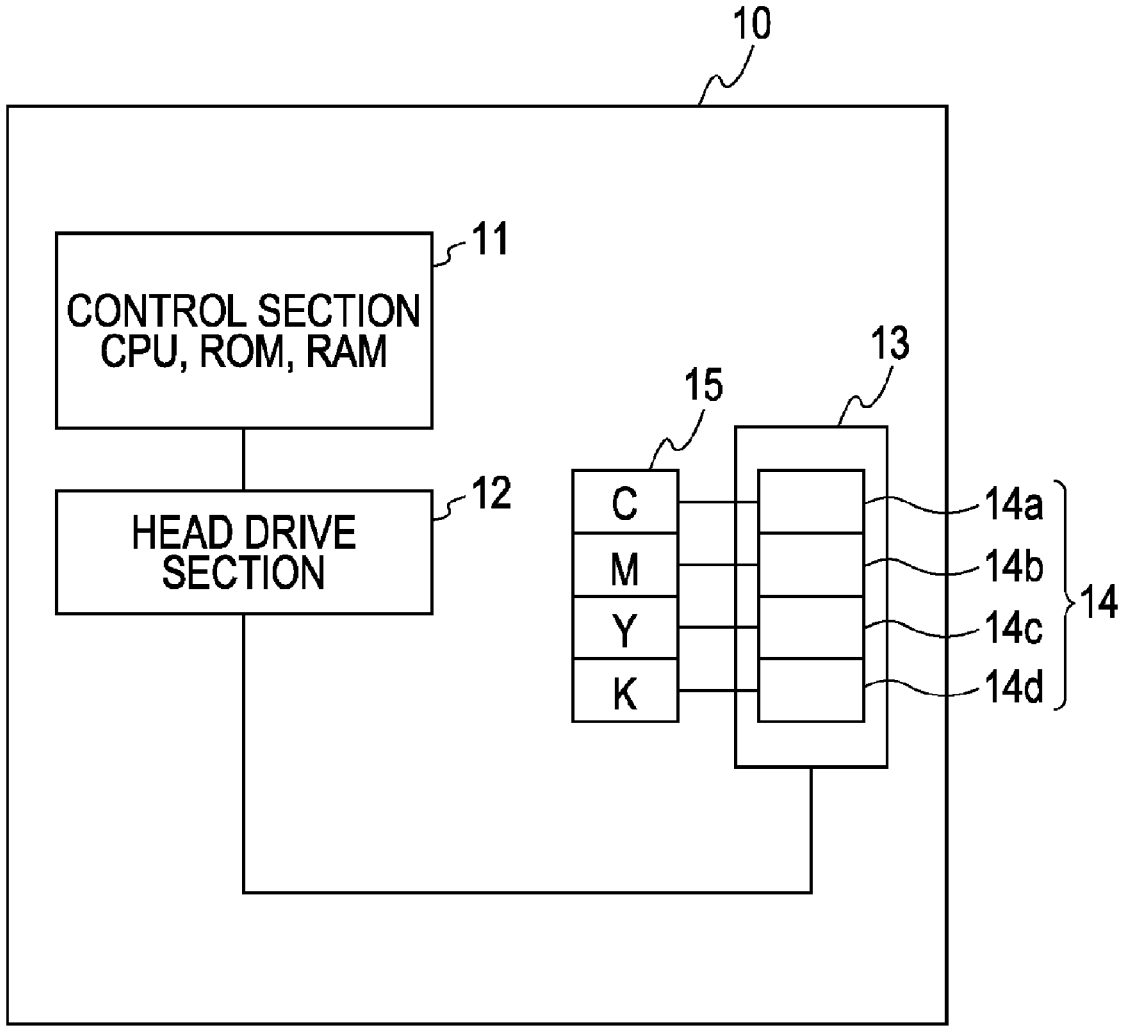
FIG. 1 is a schematic block diagram showing the configuration of an exemplary liquid ejecting apparatus.

The exemplary embodiments of the invention will now be described. In the following description, the terms "parallel" and "perpendicular" are not used in a precise mathematical sense and are merely used to describe the relative configuration of the components. Moreover, the terms "laminate" and "adjacent" are not limited to direct contact, and may include configurations where adhesive or other elements are disposed between the components FIG. 1 is a schematic block diagram showing the configuration of a liquid ejecting apparatus 10 according to an embodiment. In this embodiment, the liquid ejecting apparatus 10 is an ink jet printer, and it includes a control section 11, a head drive section 12, and a recording head unit 13. The control section 11 has a CPU (Central Processing Unit), a ROM (Read Only Memory), a RAM (Random Access Memory), and so forth. In the control section 11, the CPU controls each part according to programs written in the ROM.

The recording head unit 13 is an assembly of recording heads 14 (14*a*, 14*b*, 14*c*, and 14*d*) which each correspond to a color of ink, such as, for example, cyan (C) magenta (M), yellow (Y), and black (B). The number of recording heads 14 constituting the recording head unit 13 and the kinds of inks (liquids) that the recording heads 14 eject are not limited. On the recording head unit 13 are mounted ink cartridges 15 corresponding to the plurality of colors of ink. Each recording head 14 is provided with a plurality of ink jet nozzles (hereinafter simply referred to as nozzles) and piezoelectric elements which together comprise the nozzles. The recording head unit 13 and the recording heads 14 comprise a liquid ejecting head.

The control section 11 generates applied voltage data corresponding to raster data representing an image to be printed and outputs the applied voltage data to the head drive section 12. The applied voltage data define where or not a dot is formed at each pixel. On the basis of the applied voltage data, the head drive section 12 generates a drive voltage to be applied to each piezoelectric element provided in each recording head 14. This generated drive voltage is then supplied to each recording head 14, causing the nozzles of the recording heads 14 discharge drops of liquid. As a result, the drops are formed on a recording medium, and an image corresponding to the above raster data is printed. The liquid ejecting apparatus 10 may have other known components required for a printer, which are not shown in FIG. 1, such as a carriage mechanism, a paper feed mechanism, and a communication interface. The carriage mechanism reciprocates a carriage on which the recording head unit 13 is mounted along a guide rail. The paper feed mechanism transports a recording medium in a paper-feed direction, which is perpendicular to the reciprocating direction of the carriage, herein referred to as the main scanning direction. The recording medium is transported at a predetermined speed by driving a series of paper feed rollers. The communication interface receives the above raster data transmitted from a printer driver, such as, for example, an external PC.

Figure 2:
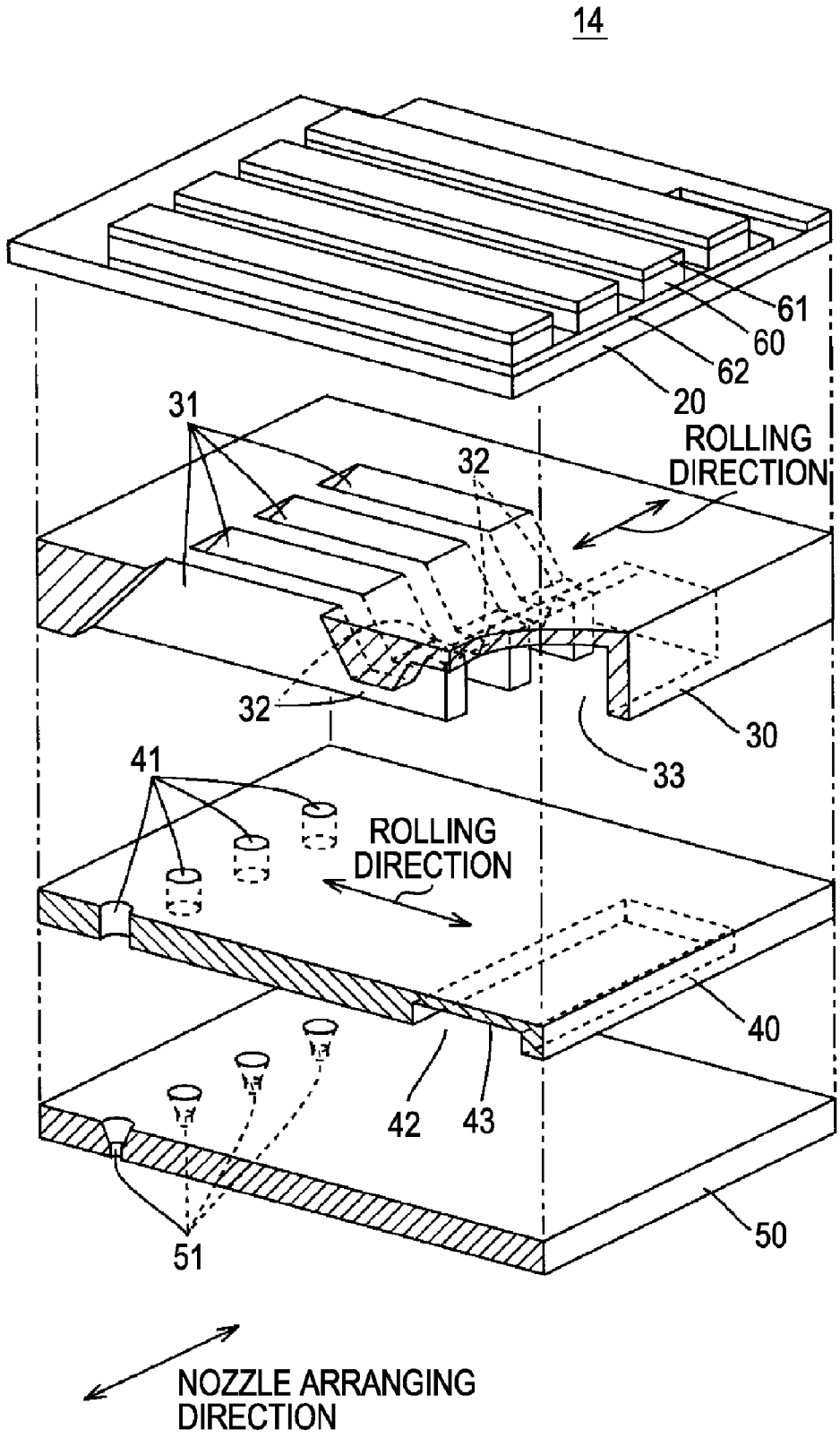
FIG. 2 is an exploded perspective view of a part of a recording head.
Figure 3:
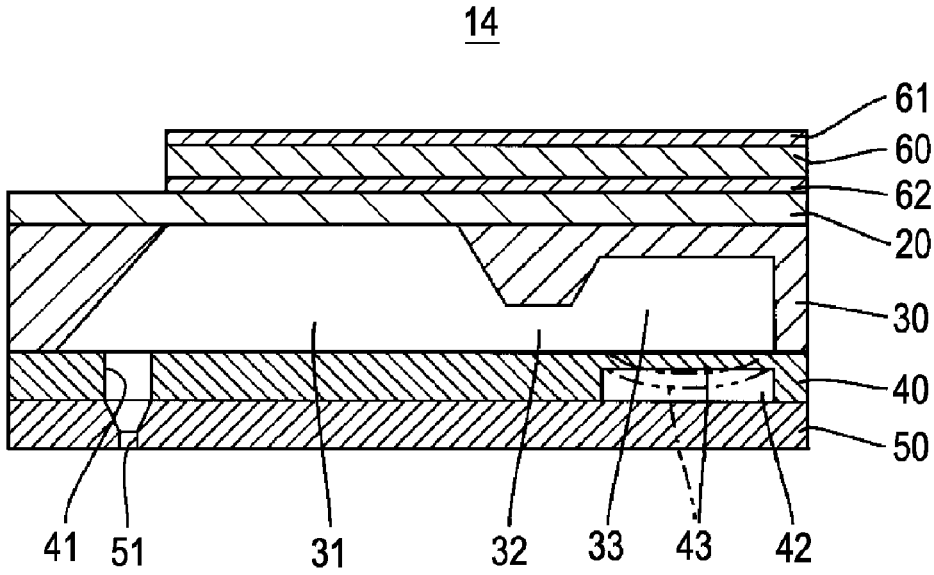
FIG. 3 is a sectional view of a part of a recording head.

FIG. 2 is an exploded perspective view showing a portion of one of the recording heads 14. FIG. 3 is a sectional view showing a part of the recording head 14. The following description is of a method for manufacturing a recording head as well as of a recording head. The recording head 14 is formed by bonding a plurality of plate-like members with adhesive and laminating them. The plurality of plate-like members are, in order, starting from the top, an elastic plate 20, a pressure chamber forming plate 30, a compliance plate 40, and a nozzle plate 50. The nozzle plate 50 comprises the lower surface of the recording head 14, and includes a plurality of nozzle orifices 51 which are arranged at a predetermined pitch in a predetermined direction, thereby forming a nozzle array corresponding to a color of ink. The direction in which the nozzle orifices 51 are arranged, herein referred to as a nozzle arranging direction, is substantially perpendicular to the main scanning direction. The nozzle plate 50 comprises a plate which is adjacent to the compliance plate. The compliance plate 40 has a plurality of communication ports 41 formed at positions corresponding to the plurality of nozzle orifices 51 and a recess 42, which has a substantially rectangular vertical section and opens toward the nozzle plate 50.

The pressure chamber forming plate 30 forms a plurality of pressure chambers 31 at positions corresponding to the plurality of communication ports 41. Each pressure chamber 31 forms a space that extends to both the upper and lower surfaces of the pressure chamber forming plate 30. The pressure chambers 31 are arranged at a predetermined pitch in the nozzle arranging direction. The pressure chamber forming plate 30 has a reservoir 33 formed therein. The reservoir 33 communicates with each pressure chamber 31 via an ink supply passage 32 corresponding to each pressure chamber 31. The ink supply passages 32 and reservoir 33 are recesses that open toward the compliance plate 40. The length of the reservoir 33 is parallel to the nozzle arranging direction, while the width thereof is perpendicular to the nozzle arranging direction.

The ink supply passages 32 are parallel to the width of the reservoir 33 and connect the reservoir 33 to the pressure chambers 31. Each pressure chamber 31 is covered by the compliance plate 40 except for the portions comprising the communication ports 41. The ink supply passages 32 and the reservoir 33 are covered by the compliance plate 40. In terms of forming the reservoir 33, the pressure chamber forming plate 30 comprises a kind of reservoir plate.

The upper openings of the pressure chambers 31 are covered by the elastic plate 20. On the upper side of the elastic plate 20, a plurality of piezoelectric elements 60 are provided at predetermined positions which correspond to the pressure chambers 31. On the top of each piezoelectric element 60 is an electrode 61. Underneath the piezoelectric elements 60 is an electrode 62. So, each piezoelectric element 60 is disposed between the electrodes 61 and 62. In this configuration, ink is supplied to the reservoir 33 from the above ink cartridge 15 via a supply passage (not shown). As a result, ink is supplied to each pressure chamber 31. The previously described drive voltage is applied to the electrodes 61 and 62 of each piezoelectric element 60 in order to deform each piezoelectric element 60. The pressure chambers 31 corresponding to the deformed piezoelectric elements 60 are also deformed, and dots are discharged downward from the corresponding nozzle orifice 51.

A recess 42 is formed under the reservoir 33, in a portion substantially corresponding to the area (horizontal sectional area) of the reservoir 33. Thus, the length and width of a thin portion, referred to as the compliance portion 43 of the compliance plate 40, has substantially the same shape as the reservoir 33, separates the reservoir 33 from the recess 42, and covers the reservoir 33. The length and width of the recess 42 also correspond to the shape of the reservoir 33. When the pressure in the reservoir 33 is increased by the supply of ink to the reservoir 33, the thin portion 43 bends so as to expand toward the nozzle plate 50, as shown by the dotted line in FIG. 3, thereby absorbing the pressure in the reservoir 33.

In this embodiment, the pressure chamber forming plate 30, the compliance plate 40, and the nozzle plate 50 are formed of a metal plate made by rolling metal. The above various recesses and through-holes are formed, for example, by etching. When metal is rolled in a direction, rolling marks are formed on the surface of the resulting metal plate along the rolling direction. The rolling marks appear as minute lines, which extend along the rolling direction. When a cross-section of the metal plate is viewed in a direction perpendicular to the rolling direction, minute notches are formed on the rolled surface. The lines formed on the surface of the metal plate function as beams, making it difficult to bend the rolled metal plate in the rolling direction but easy to bend in a direction perpendicular to the rolling direction.

In this embodiment, as shown in FIG. 2, the rolling direction of the compliance plate 40 is substantially parallel to the length of the recess 42 and the thin portion 43. In other words, when the compliance plate 40 is made of a metal plate, the recess 42 and the communication ports 41 are formed so to have a length which is substantially parallel to the rolling direction of the metal plate. As a result, the above lines run on the surface of the compliance plate 40 and thin portion 43 along the length of the recess 42.

Figure 4:
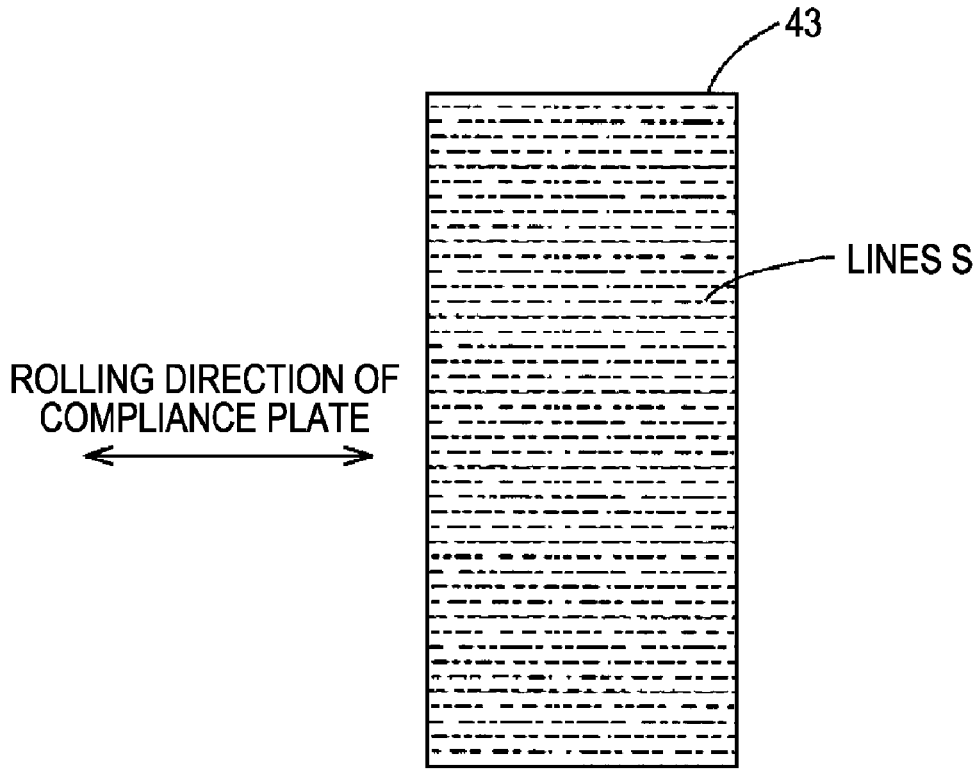
FIG. 4 shows the surface of a thin portion of the compliance plate.

FIG. 4 illustrates the surface of the thin portion 43. The figure shows a substantially rectangular portion of the compliance plate 40 comprising the thin portion 43. Many lines S are formed on the surface of the thin portion 43 along the length of the thin portion 43. In many cases, the lines S are actually too minute for the naked eye to see.

In this embodiment, as shown in FIG. 2, the rolling direction of the pressure chamber forming plate 30 is substantially perpendicular to the rolling direction of the compliance plate 40. In other words, when the pressure chamber forming plate 30 is made of a metal plate, the reservoir 33 is formed with a length that is substantially perpendicular to the rolling direction of the metal plate. As a result, the previously described lines run on the surface of the pressure chamber forming plate 30 in a direction that is substantially perpendicular to the length of the reservoir 33.

As described above, according to this embodiment, the thin portion 43 has a plurality of lines (beams) formed along the length of the recess 42. So, the thin portion 43 does not easily bend in the direction of the width of the recess 42. As for the longitudinal direction of the recess 42, bending is prevented by the many short beams on the thin portion 43. This is because the thin portion 43 has more and shorter beams than it does when beams run in the longitudinal direction of the recess 42. As a result, the whole thin portion 43 is harder to bend. So, if the amount of ink supplied to the reservoir 33 is increased due to the densification of nozzles of the recording head 14 and the thickness of the compliance plate 40 is reduced for downsizing, the thin portion 43 is prevented from excessively bending beyond the depth of the recess 42 and coming into contact with the nozzle plate 50

In addition, the rolling directions of the compliance plate 40 and the pressure chamber forming plate 30, which are in contact with each other, are substantially perpendicular. So, the compliance plate 40 and the pressure chamber forming plate 30 prevent each other's warping, meaning that the whole recording head 14 is unlikely to warp. As a result, variation between the nozzle orifices 51 in the distance to a recording medium caused by the warping of the recording head 14 decreases, and a high-quality product can be provided.

Configurations where the rolling directions of other components are defined may also be used. For example, the rolling direction of the nozzle plate 50 may also be limited. In this case, the rolling direction of the nozzle plate 50 is preferably substantially perpendicular to the nozzle arranging direction. In other words, when the nozzle plate 50 is made of a metal plate, the rolling direction of the nozzle plate is preferably substantially perpendicular to the nozzle arranging direction of the nozzle plate 50. As a result, the rolling directions of the pressure chamber forming plate 30 are substantially the same, with the compliance plate 40 being disposed between the two components. Using this configuration, the warping of the compliance plate 40 may be prevented, except where the thin portion 43 is formed. Thus, the warping of the recording head 14 may be prevented.

Figure 5:
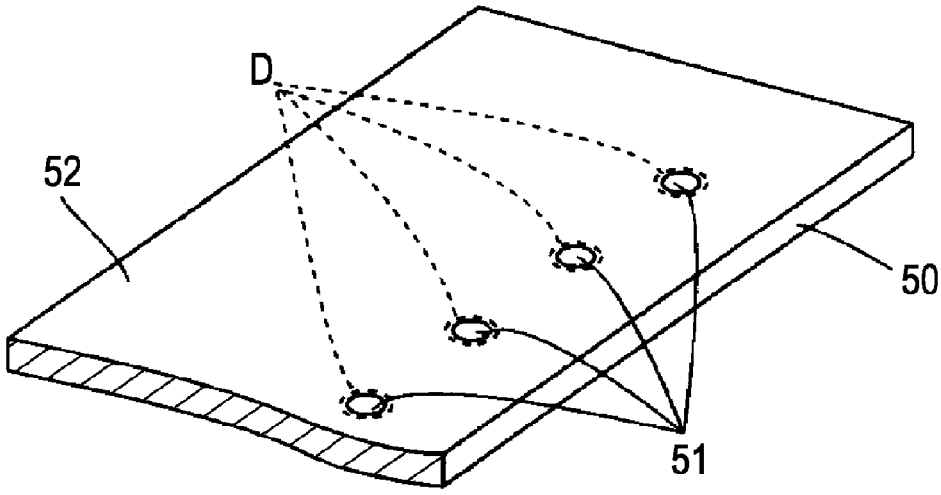
FIG. 5 is a sectional view of a portion of the ink discharging surface of a recording head.

FIG. 5 is a perspective sectional view of a part of the ink discharging surface 52 of the nozzle plate 50. The ink discharging surface 52 is opposite a recording medium and normally faces downward. However, in the figure, ink discharging surface 52 faces upward for convenience of explanation. After repeated use of the recording head 14, a small amount of solidified ink D, shown by the dotted lines, may accumulate around each nozzle orifice 51. A drop discharged from each nozzle orifice 51 may be adversely affected by the solidified ink D, for example, preventing the ink droplet from flying straight. So, the liquid ejecting apparatus 10 periodically performs a cleaning process to remove such ink D, form the ink discharging surface.

Figure 6:
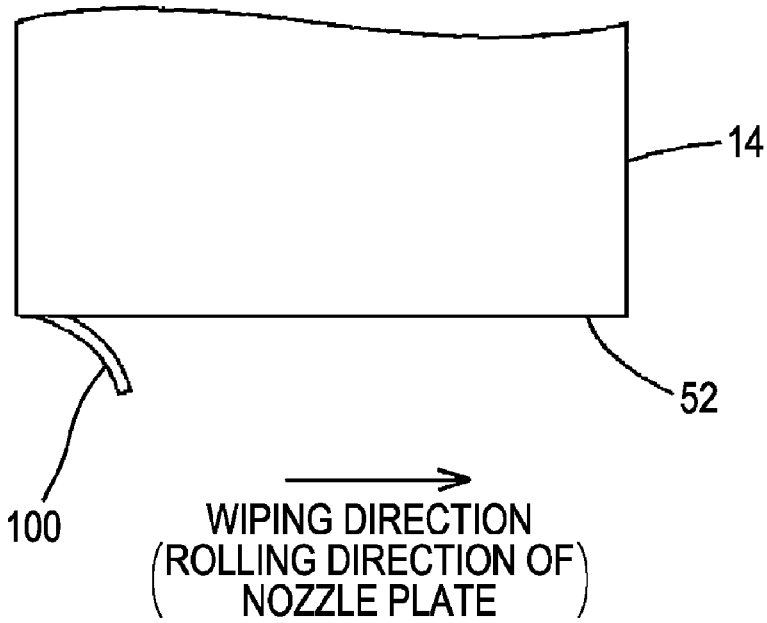
FIG. 6 shows the cleaning of the ink discharging surface.

During the cleaning process, as shown in FIG. 6, a wiper 100 formed of a material having a predetermined softness rubs the ink discharging surface 52 in a given direction, thereby removing the ink D. A liquid ejecting apparatus 10 comprising a printer has the wiper 100 and a drive mechanism for driving the wiper 100. The control section 11 controls the drive mechanism to perform the cleaning process. The wiper 100, the drive mechanism for driving the wiper 100, and the control section 11 that control the drive mechanism constitute a cleaning section. The direction that the wiper 100 is moved, referred to as the cleaning direction, is normally parallel to the nozzle arranging direction. So, when the rolling direction of the nozzle plate 50 is substantially parallel to the nozzle arranging direction, the rolling marks (lines) on the ink discharging surface 52 run substantially parallel to the cleaning direction. If the lines on the ink discharging surface 52 intersect the cleaning direction, ink D swept by the wiper 100 can pile up between the lines. When the direction of lines on the ink discharging surface 52 is parallel to the cleaning direction, ink D is prevented from piling up and is appropriately swept out along the lines on the ink discharging surface 52.

In the above embodiments, the liquid ejecting heads and liquid ejecting apparatuses eject ink onto a recording medium in order to perform a printing process. However, the configuration of the invention can be applied to any apparatus that ejects liquid onto an object, such as a color material ejecting apparatus used for manufacturing a color filter, or an organic matter ejecting apparatus used for manufacturing biochips. Although, in the above embodiments, the liquid ejecting heads discharge liquid using piezoelectric elements 60, various other pressure generators, such as heater elements, may also be used.

What is claimed is:

1. A liquid ejecting head comprising:

a plurality of nozzle orifices capable of ejecting a liquid;

a reservoir plate made of a rolled metal rolled in a first direction and forming a liquid reservoir which communicates with the plurality of nozzle orifices; and a compliance plate made of rolled metal rolled in a second direction which is laminated on the reservoir plate and having a thin portion that is formed by forming a recess which extends in a lengthwise direction in the surface of the compliance plate which is opposite to the surface facing the liquid reservoir, the thin portion forming a surface of the liquid reservoir, wherein the thin portion includes a plurality of beams formed on the surface of the thin portion, the plurality of beams being configured to at least partially prevent flexing of the thin portion in a longitudinal direction of the recess, wherein the second direction is perpendicular to the longitudinal direction of the recess and the first direction is perpendicular to the second direction.

2. The liquid ejecting head according to claim 1, further comprising a compliance adjacent plate made of rolled metal which is laminated on the compliance plate on the opposite surface of the compliance plate from the surface in contact with the reservoir plate, and wherein the compliance adjacent plate is rolled in the second direction.

3. The liquid ejecting head according to claim 2, wherein the compliance adjacent plate is a nozzle plate having the plurality of nozzle orifices arranged parallel to the first direction.

4. The liquid ejecting head according to claim 1, wherein the thin portion flexes in order to expand the volume of the liquid reservoir in order to absorb the pressure in the liquid reservoir.

5. The liquid ejecting head according to claim 1, wherein the thin portion flexes in order to expand the volume of the liquid reservoir in order to absorb the pressure in the liquid reservoir.

6. A liquid ejecting apparatus capable of ejecting liquid from a plurality of nozzle orifices, the apparatus including a liquid ejecting head section comprising:

a reservoir plate made of rolled metal rolled in a first direction, the reservoir plate forming a liquid reservoir which is capable of communicating with the plurality of nozzle orifices; and a compliance plate made of rolled metal rolled in a second direction which is disposed on the reservoir plate and having a thin portion that is formed by forming a recess which extends in a lengthwise direction in the surface of the compliance plate which is opposite to the surface facing the liquid reservoir, the thin portion forming a surface of the liquid reservoir, wherein the thin portion includes a plurality of beams formed on the surface of thin portion, the plurality of beams being configured to at least partially prevent flexing of the thin portion in a longitudinal direction of the recess, wherein the second direction is perpendicular to the longitudinal direction of the recess and the first direction is perpendicular to the second direction.

7. The liquid ejecting apparatus according to claim 6, wherein the liquid ejecting head section further comprises:

a compliance adjacent plate made of rolled metal rolled in the second direction which is laminated on the opposite side of the compliance plate from the reservoir plate, the compliance adjacent plate comprising the plurality of nozzle orifices which are formed in a direction parallel to the second direction; and a wiping section that performs a cleaning process in a direction parallel to the second direction.

8. The liquid ejecting head apparatus according to claim 6, further comprising a compliance adjacent plate made of rolled metal which is laminated on the compliance plate on the opposite surface of the compliance plate from the surface in contact with the reservoir plate, and wherein the compliance adjacent plate is rolled in the second direction.

9. The liquid ejecting head apparatus according to claim 8, wherein the compliance adjacent plate is a nozzle plate having the plurality of nozzle orifices arranged parallel to the first direction.

* * * * *